US006540965B2

(12) United States Patent
Bara

(10) Patent No.: US 6,540,965 B2
(45) Date of Patent: Apr. 1, 2003

(54) BIOLOGICAL ANALYSIS AND APPARATUS FOR STORAGE OF BIOLOGICAL SAMPLES

(75) Inventor: Nicolas Bara, La Villetertre (FR)

(73) Assignee: Central Labo Europe S.A.R.L. (FR)

( * ) Notice: Subject to any disclaimer, the term of this patent is extended or adjusted under 35 U.S.C. 154(b) by 0 days.

(21) Appl. No.: 09/757,282

(22) Filed: Jan. 9, 2001

(65) Prior Publication Data

US 2001/0005491 A1 Jun. 28, 2001

Related U.S. Application Data

(63) Continuation of application No. PCT/FR99/01720, filed on Jul. 13, 1999.

(30) Foreign Application Priority Data

Jul. 13, 1998 (FR) ..... 98 08996

(51) Int. Cl.[7] ..... B01L 3/00

(52) U.S. Cl. ..... 422/102; 422/99; 422/104; 435/283.1; 220/23.2; 220/23.4; 220/23.8; 206/557; 206/558

(58) Field of Search ..... 422/99, 100, 101, 422/102, 104; 435/283.1, 288.3, 288.4; 220/23.2, 23.4, 23.6, 23.8, 23.83, 507; 206/557, 558, 561, 807

(56) References Cited

U.S. PATENT DOCUMENTS

| | | | | | |
|---|---|---|---|---|---|
| 3,907,505 | A | | 9/1975 | Beall et al. | |
| 4,154,795 | A | | 5/1979 | Thorne | |
| 4,255,522 | A | | 3/1981 | Fusenig et al. | |
| 4,829,006 | A | * | 5/1989 | Smith et al. | 435/301 |
| 4,877,659 | A | * | 10/1989 | Vince | 428/34.1 |
| 5,096,672 | A | * | 3/1992 | Tervamaki et al. | 422/102 |
| 5,110,556 | A | * | 5/1992 | Lyman et al. | 422/101 |
| 5,207,150 | A | * | 5/1993 | Wellman et al. | 99/439 |
| 5,358,871 | A | * | 10/1994 | Stevens et al. | 435/284 |
| 5,514,343 | A | * | 5/1996 | Verwohit et al. | 422/104 |
| 5,544,778 | A | * | 8/1996 | Goncalves | 220/23.4 |
| 5,603,899 | A | * | 2/1997 | Franciskovich et al. | 422/100 |
| 5,670,118 | A | | 9/1997 | Sponholtz | |
| 5,683,659 | A | * | 11/1997 | Hovatter | 422/102 |
| 5,795,748 | A | * | 8/1998 | Cottingham | 435/91.2 |
| 5,899,353 | A | * | 5/1999 | Sabin et al. | 220/507 |
| 5,916,812 | A | * | 6/1999 | Chen et al. | 436/18 |
| 5,948,363 | A | * | 9/1999 | Gaillard | 422/102 |
| 6,000,535 | A | * | 12/1999 | Berk et al. | 206/63.5 |
| 6,001,310 | A | * | 12/1999 | Shaffer et al. | 422/102 |
| 6,106,783 | A | * | 8/2000 | Gamble | 422/102 |
| 6,168,760 | B1 | * | 1/2001 | Horn | 422/67 |

FOREIGN PATENT DOCUMENTS

| | | |
|---|---|---|
| EP | 0 688 602 A2 | 12/1995 |
| WO | WO 94/00238 | 1/1994 |
| WO | WO 98/05427 | 2/1998 |

* cited by examiner

*Primary Examiner*—Jill Warden
*Assistant Examiner*—Dwayne K. Handy
(74) *Attorney, Agent, or Firm*—Schnader Harrison Segal & Lewis LLP

(57) ABSTRACT

A microtitration plate including a plastic base having a multiplicity of cups shaped and sized to receive biological liquid samples, each cup being surrounded by an attenuated zone and having an upper collar sized and shaped to cooperate with a complementary sized and shaped tool to exert a torsional force on the upper collar, thereby causing detachment of the cup by tearing at least a portion of the attenuated zone.

15 Claims, 4 Drawing Sheets

BIOLOGICAL ANALYSIS AND APPARATUS FOR STORAGE OF BIOLOGICAL SAMPLES

RELATED APPLICATION

This is a continuation of International Application No. PCT/FR99/01720, with an international filing date of Jul. 13, 1999, which is based on French Patent Application No. 98/08996, filed Jul. 13, 1998.

FIELD OF THE INVENTION

This invention pertains to the field of biological analysis and the storage of biological samples.

BACKGROUND

It is known in the state of the art to use plates which are generally referred to as "microtitration plates." These plates present generally a multiplicity of wells organized according to a two-dimensional grid. Each well can contain a biological sample.

As an example, European patent EP 611597 describes a microntiration unit comprising at least one recipient made of a transparent material and which has an orifice intended for receiving a biological test reaction mixture.

Also known are the patents BE 902982, EP 688602, U.S. Pat. Nos. 4,154,975, 3,907,505 and 4,255,522. which pertain to different implementations of biological test plates. European patent EP 92140 describes a microtest plate comprising a frame and a central part equipped with recipients, characterized in that the top edge of the frame of the microtest plate is separate from the central part, with the exception of several points of connection via a continuous opening, in that it comprises crosspieces perpendicular to its surface and recesses, preferably small notches, arranged opposite each other between the crosspieces on the lower support edge of the frame.

European patent EP 84102 describes a microtitration plate for the diagnosis of blood groups constituted by a flat-bottom plate made of rigid, transparent polystyrene, characterized in that the bottoms of the cups present dry adherent layers essentially made of pure antiserums and in that the cups are composed of a polystyrene capable of protein binding, sterilized by radiation, such as surface treatment for cell cultures.

These plates are in widespread use in biological analysis laboratories. The content of the wells is transferred into a well reader in which a biochemical reaction is produced by means of pipettes. These pipettes are sometimes automated and supported by a robot to enable multipipetting. Nevertheless, these solutions require considerable skill as well as costly equipment.

Thus, it would be advantageous to provide a plate that allows separation of the wells on an as-needed basis, thereby avoiding the transfer of the well content into the analysis equipment. Such a plate would also enable storage of various types of biological samples in the form of a single plate, and the use of a well if needed.

SUMMARY OF THE INVENTION

The invention relates to a microtitration plate including a plastic base having a multiplicity of cups shaped and sized to receive biological liquid samples, each cup being surrounded by an attenuated zone and having an upper collar sized and shaped to cooperate with a complementary sized and shaped tool to exert a torsional force on the upper collar, thereby causing detachment of the cup by tearing at least a portion of the attenuated zone.

BRIEF DESCRIPTION OF THE DRAWINGS

Better comprehension of the invention will be obtained from the description below which refers to the attached drawings in which.

DETAILED DESCRIPTION

Figure 1:
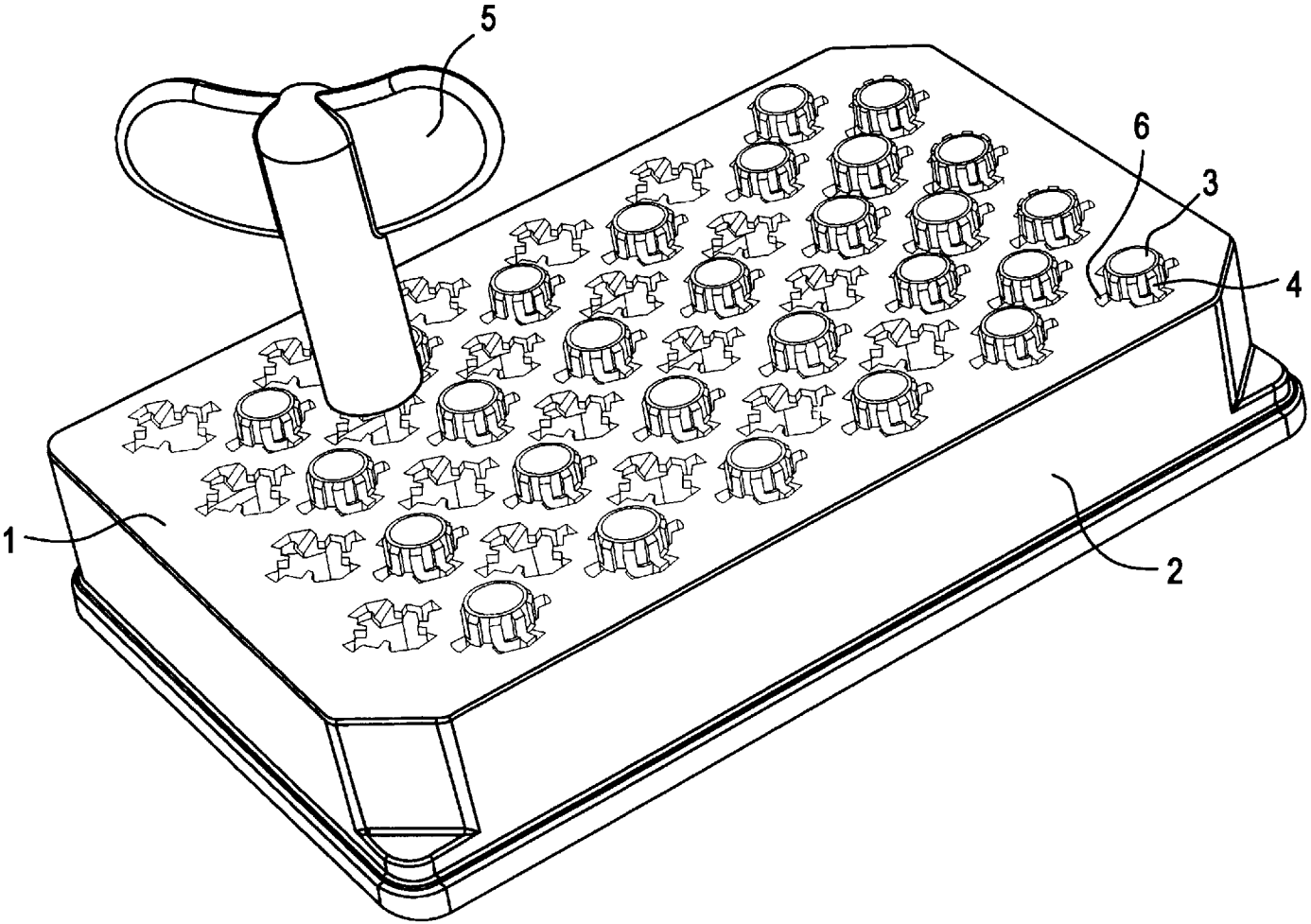
FIG. 1 shows a perspective view of a plate according to the invention from above.

The following description is intended to refer to specific embodiments of the invention illustrated in the drawings and is not intended to define or limit the invention, other than in the appended claims. Also, the drawings are not to scale and various dimensions and proportions are contemplated.

The invention pertains to a plate intended especially for microtitration, which plate presents a multiplicity of cups for receiving samples of a biological liquid, characterized in that the cups are detachable. The plate according to the invention is advantageously constituted by a molded plastic part presenting a multiplicity of hollow protuberances constituting the cups, with each of these protuberances being surrounded by a scored line.

According to a preferred variant, the cups are extended above the top surface of the plate by a collar that can cooperate with a tool that allows exertion of a rotation which causes the cup to be torn off. According to a particular mode of implementation, the cups are surrounded by a tear zone presenting attenuated lines. The cups are preferably surrounded by a zone that presents alternately radial reinforcements extending the cup and openings of a section equal at least to that of the radial reinforcements. The cups are advantageously surrounded by a tear zone presenting semicircular shoulders that form an inclined plane on which come to slide the radial extensions of the cups during their separation from the plate by means of a movement of rotation.

According to a variant, the wells present individual identification labels. According to another variant, the plate presents an individual identification label. According to one example of implementation, the identification labels are constituted by bar codes embedded in the plastic. According to another example of implementation, the identification labels are constituted by remotely readable means embedded in the plastic.

Turning now to the drawings, FIG. 1 shows a perspective view of a plate from above according to the invention. The plate is made of molded plastic. It has a top surface/base (1) and a peripheral edge (2) extending substantially perpendicularly therefrom. The peripheral edge (2) is convergent so as to allow stacking or partial nesting of superposed plates.

The top surface (1) has a multiplicity of cups (3) the openings of which are surrounded by serrated collars (4). Each collar (4) can receive a key (5) of complementary section which fits into spaced apart radial extensions that extend from the cup and form grooves with widths substantially equal to at least the width of the radial extensions. Key (5) makes it possible to exert on collar (4) of a cup a torsional force that causes tearing of scored zone (6) surrounding the cup. When zone (6) is torn, the cup is released and can be separated from the top surface (1) of the plate.

Figure 2:
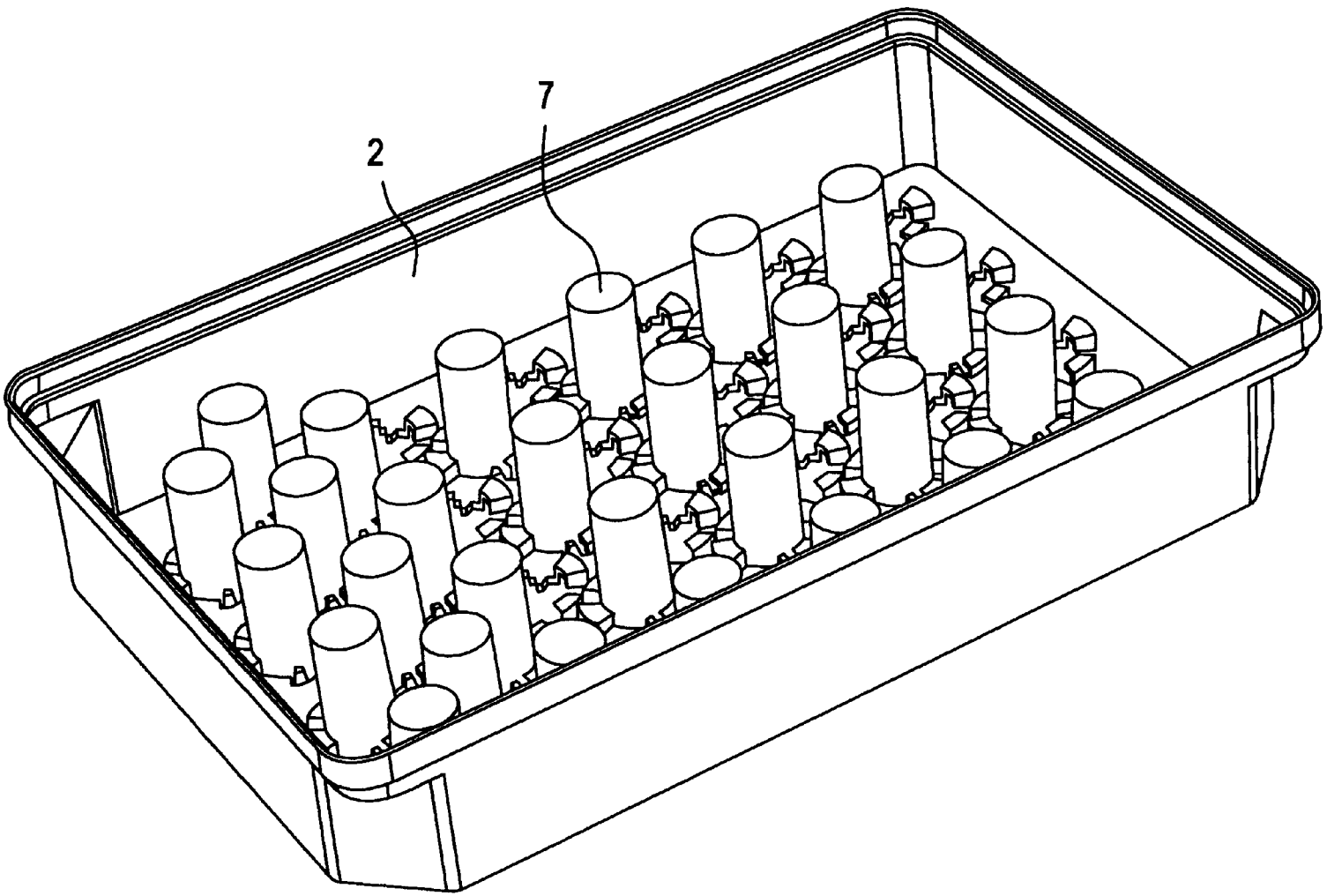
FIG. 2 shows a perspective view of a plate according to the invention from below.

FIG. 2 shows a perspective view of a plate from below according to the invention. The cup (3) has the form of a hollow substantially cylindrical body (7). The height of the cups is slightly less than that of the peripheral edge (2) to allow the plate to rest in stable equilibrium on a flat surface.

Figure 3:
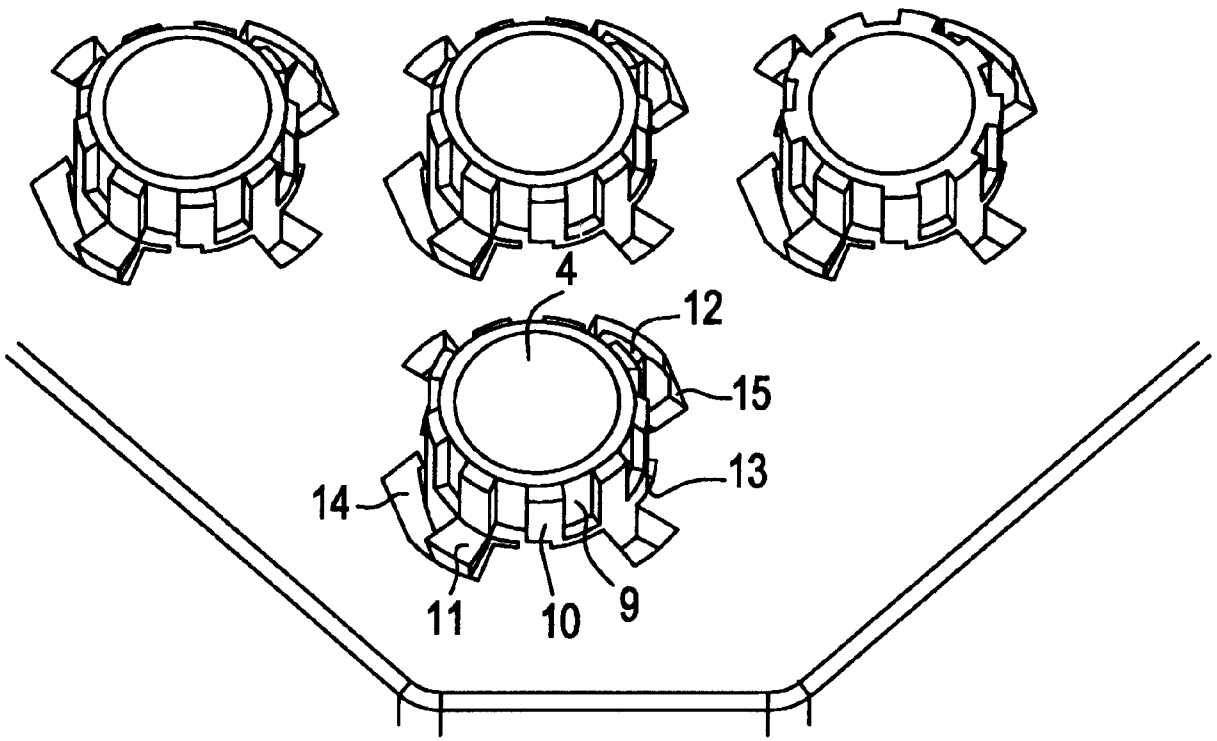
FIG. 3 shows an enlarged top view of a portion of the plate.

FIG. 3 shows an enlarged top view of the plate. The collar (4) is of serrated form and comprises alternating notches (9) and protruding projections (10). The collar (4) also has radial extensions (11, 12) constituting reinforcement zones. The connection between the collar (4) and the surface of the plate (1) is made by means of an attenuated zone (13) surrounding the collar.

Attenuation is implemented by means of a reduced thickness of the plastic which facilitates tearing when a force is exerted on the collar, especially by means of key (5) which facilitates transmission of a torsional force. When the collar (4) of a cup is rotated, the peripheral attenuated zone tears and the radial extensions (11, 12) come into contact with the semicircular ramps (14) provided in their angular extension. The cup (3) on which the rotational force was exerted is thereby pushed upwardly and can be easily removed from the plate to be introduced into a reader or for any other operation.

Figure 4:
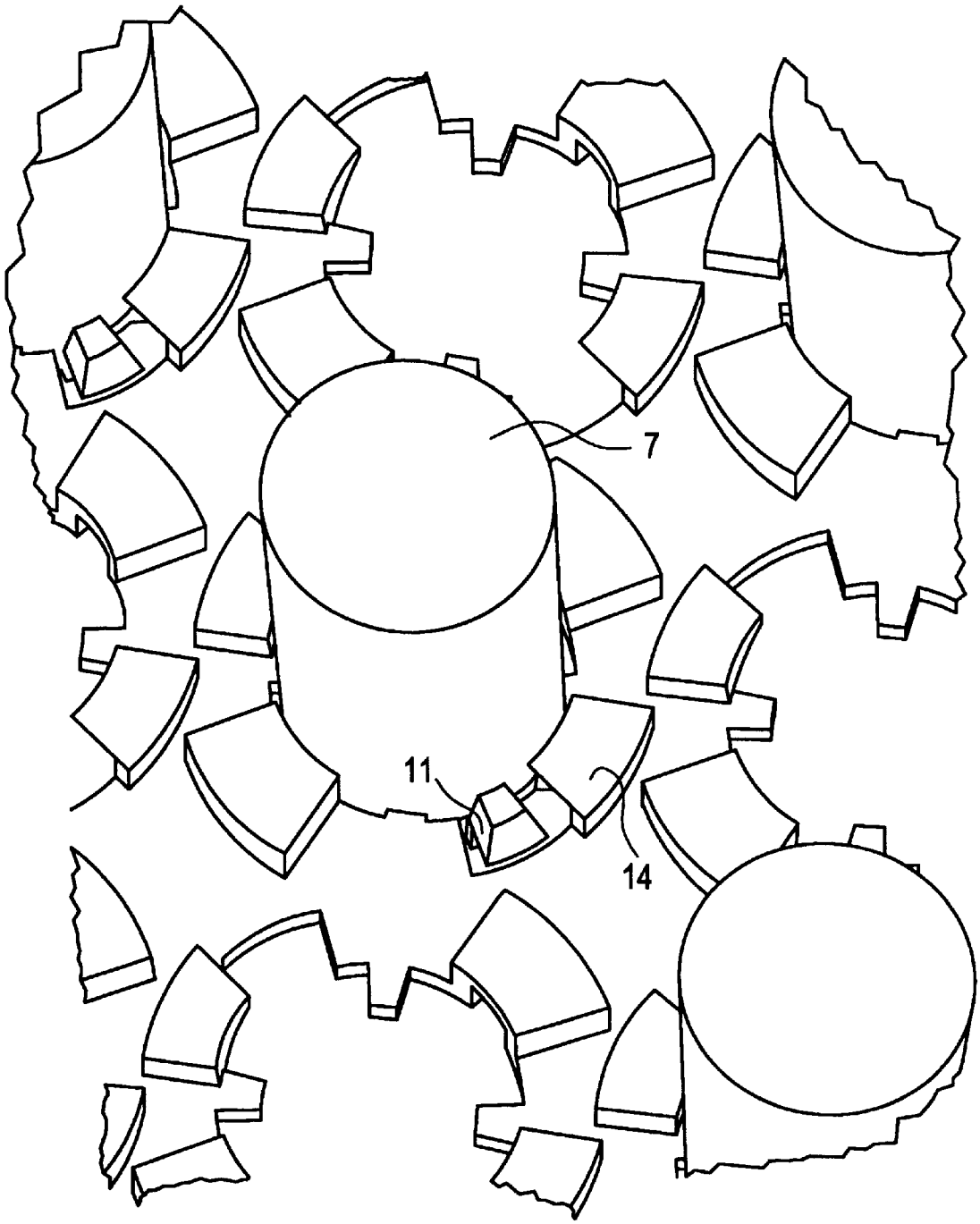
FIG. 4 shows an enlarged bottom view of a portion of the plate.

FIG. 4 shows an enlarged bottom view. The substantially cylindrical body (7) is surrounded by the attenuated zone. The plate has zones (14) in the form of a spiral ramp on which the radial extensions (11) slide. The plate can be made by molding in a single-slide mold.

Each of the plates can bear a specific identification means, for example, a bar code or a two-dimensional code cast in the plastic. Likewise, each of the cups can bear a specific identification means, for example a bar code or a two-dimensional code cast in the bottom of the cylindrical part.

One variant consists of equipping each plate with a radio-frequency or coded magnetic label. This label, which can have various forms, for example, the form of an integrated circuit or a coded magnetic wire, can be integrated in the material so as to allow remote identification. Also, the base may have a slot to introduce a strip bearing a remote identification label. Preferably, the strip has at least one locking serration. This identification can be carried on the plate or on the cup.

It can be advantageous for certain applications if the labeling of all the cups is identical and possibly identical to that of the plate. For other applications, the plate can be labeled with a unique code, and the cups can be labeled with a code comprising the identification code of the plate supplemented with a code pertaining to the cup.

Finally, it is advantageous to include tamper-prevention filaments fixed between the top surface/base and at least one of the cups, preferably a filament for each cup.

What is claimed is:

1. A microtitration plate comprising a plastic base having a multiplicity of cups shaped and sized to receive biological liquid samples, each cup being connected to the plate and surrounded by an attenuated zone and having an upper collar sized and shaped to receive a torsional force, thereby causing detachment of said cup from the plate by tearing at least a portion of said attenuated zone.

2. The plate according to claim 1, wherein the collar is serrated and has alternating notches and protruding projections.

3. The plate according to claim 1, wherein each cup is surrounded by an attenuated zone having spaced apart radial extensions that extend from the cup and form grooves with widths substantially equal to at least the width of the radial extensions.

4. The plate according to claim 3, wherein the collars are surrounded by a tear zone having semicircular shoulders that form an inclined plane on which the radial extensions slide upon their separation from the base by rotational movement.

5. The plate according to claim 1, wherein the cups have individual identification labels.

6. The plate according to claim 1, wherein the base has an individual identification label.

7. The plate according to claim 5, wherein the identification labels are bar codes embedded in the plastic.

8. The plate according to claim 6, wherein the identification labels are bar codes embedded in the plastic.

9. The plate according to claim 5, wherein the identification labels are radio-frequency or coded magnetic labels and embedded in the plastic.

10. The plate according to claim 6, wherein the identification labels are radio-frequency or coded magnetic labels and embedded in the plastic.

11. The plate according to claim 1, further comprising tamper evident film fixed on the base and each cup.

12. The plate according to claim 1, wherein the base has a slot for introduction of a strip bearing a remote identification label.

13. The plate according to claim 12, wherein the strip has at least one lock.

14. The plate according to claim 1, further comprising covers that fit on at least a part of the cups to seal said cups.

15. A microtitration plate comprising:

a base member having a substantially flat surface and containing a plurality of openings;

a cup positioned within each opening and fixed to the base portion with a tearable portion that permits detachment of the cup from the base member by severing the tearable portion upon application of torque force; and an upper collar for each cup sized and shaped to receive said torque force.

* * * * *